US005412884A

United States Patent [19]

Staples et al.

[11] Patent Number: 5,412,884

[45] Date of Patent: May 9, 1995

[54] WASTE MATERIAL POND CLEANING APPARATUS

[76] Inventors: Wesley A. Staples, Rte. 3, Box 1512; Russell E. Staples, Rte. 5, Box 8082, both of Palatka, Fla. 32177

[21] Appl. No.: 130,985

[22] Filed: Oct. 4, 1993

[51] Int. Cl.[6] ..... E02F 3/00

[52] U.S. Cl. ..... 37/342; 37/314

[58] Field of Search ..... 172/779, 787, 799.5, 172/684.5, 786, 26.5; 37/214, 341, 309, 314, 342

[56] References Cited

U.S. PATENT DOCUMENTS

| | | | |
|---|---|---|---|
| 231,581 | 8/1880 | Howland . | |
| 273,998 | 3/1883 | Jamieson | 172/26.5 |
| 311,746 | 2/1885 | Hallowell . | |
| 526,675 | 10/1894 | Bernard | 172/26.6 |
| 754,611 | 3/1904 | Riley | 37/341 X |
| 963,562 | 7/1910 | Hopkins . | |
| 1,034,501 | 8/1912 | Peterson | 37/341 X |
| 1,096,137 | 5/1914 | Soule | 172/26.5 |
| 1,192,127 | 7/1916 | Shostrom | 172/26.6 |
| 1,303,415 | 5/1919 | Thurston . | |
| 1,437,358 | 11/1922 | Pratt . | |
| 2,812,596 | 11/1957 | Schofield | 37/147 |
| 2,864,182 | 12/1958 | Russell | 37/125 |
| 3,276,152 | 10/1966 | Knap | 37/341 X |
| 4,056,328 | 11/1977 | Maxey | 404/96 |

FOREIGN PATENT DOCUMENTS

| | | | |
|---|---|---|---|
| 23214 | of 0000 | United Kingdom | 172/26.6 |
| 1728911 | 4/1992 | U.S.S.R. | 37/394 |

*Primary Examiner*—Randolph A. Reese
*Assistant Examiner*—Victor Batson
*Attorney, Agent, or Firm*—Kerkam, Stowell, Kondracki & Clarke; Harold L. Stowell

[57] ABSTRACT

A dragline apparatus for cleaning waste material and sludge in clarifier and settling ponds and lagoons includes a pair of side walls and a back wall forming a frame supported on front and rear flotation rollers. Between the home member is at least one blade, pivotally mounted for swinging movement from an active to an inactive position. Cables are connected to the front and rear of the frame and to prime movers on the banks of a pond to be cleaned.

4 Claims, 5 Drawing Sheets

WASTE MATERIAL POND CLEANING APPARATUS

FIELD OF THE INVENTION

This invention relates to an apparatus for cleaning waste material sludge and soft solids in clarifier settling ponds and lagoons. The invention will be further described in respect to the recovery of soft solids in pools which may be five to twenty-plus feet deep and two hundred to eight hundred feet wide, and any length, and enclose as much as eighty or more acres.

BACKGROUND OF THE INVENTION

All categories of waste have created gigantic service industries directed to clean-up and disposal of wastes. One of the large waste problems has been created by the pulp and paper industry, where waste materials have been stored in "sludge," "polishing," "processing," and the like ponds. Such ponds are normally located in the waste system from the mill clarifiers. As the waste gathers in the mill's waste system, the wastes are pumped into clarifier(s) for the start of the separation of solids from liquids.

In the pulp and paper industry, much of the solids material is paper waste becoming fiber in the waste system and accounts for 90%-plus of the wasted solids. As the clarifier separates the solids, they are pumped out of the bottom of the clarifier as they sink and are pumped into these "ponds" for breakdown by microorganisms. Generally, the solids are left in the pond and, through "weir gates," the liquid is returned to the clarifier for further clarifying and, eventually, to an oxidation pond for additional clarification and eventual return to public waterways.

The solid materials left in the pond to further decay and be completely broken down to inert material and dead "bugs" are the subject of our further discussion here. This material is left to accumulate for a number of years and, in time, it fills the total capacity of the pond to a point that the pond is no longer functional and becomes inefficient, sending more and more solids back into the clarifier. These ponds, full of these soft-solids and water, and each covering 80 acres or more, may be 5 to 20 feet deep, and 200 to 800 feet in width. The removal of this soft-solid material from the lagoon and into a retention or land-fill area becomes a real challenge to man and machine.

The state-of-the-art approach for cleaning ponds seems to be as follows:

A. Divert the material "slurry" flow into an alternate pond or divide the pond with a dirt dike, which will later be removed, and divert the flow into one side of the pond. Pump all liquid into the same pond to which the flow of material is being diverted.

B. Reach as far out as possible with a dragline or long-reach excavator to remove all reachable materials from the bank of the pond.

C. Place a light-weight, low ground pressure (LGP) bulldozer into the pit of the pond to push the remaining solids to the bank so that it can be loaded out by conventional means.

Item C. above has many drawbacks; with the soft bottom of the pond and the ooze factor of the sludge, the bulldozer units are bogged down in the bottom much of the time, and these small tractors can push only small payloads, resulting in very low production.

The present invention is not limited to ponds containing soft pulp and liquids and may be useful, as disclosed in U.S. Pat. No. 4,753,737. In the pulp and paper industry, a very caustic solution called white liquor is used in the digesters for cooking wood chips for the production of pulp. This combination (wood chips and white liquor) is sealed in a cooker, and steam is introduced, and it "cooks" under high pressure. After cooking, this mixture is "blown" from the digester and goes through a separation process. This process separates the pulp from the liquid, which is referred to as black liquor. The black liquor contains several byproducts—turpentine and "soap" (from which tall oil is made) are two—plus residual chemicals and B.T.U. (heat) values. After the by-products are removed, the black liquor contains chemical and B.T.U. solids in the magnitude of about 10%. The higher the solids, the greater the value of the black liquor. In order to recover the values, the black liquor is processed through evaporators in which the water is removed, and, in several stages, the solids content is raised to 55%–62% for burning in recovery boilers. In the burning process in the recovery boiler, the heat value is removed for the production of energy, and the chemical elements form a smelt matter called green liquor. This green liquor drops into a heat sink-pool at the bottom of the boiler and is removed for processing through a lime kiln for the production of white liquor. Quite frequently, prior to recovery of the values in the black liquor, the black liquor is stored in ponds, pools and lagoons.

These large lagoons contain vast amounts of liquor, ranging in solids content from weak 2%–20% to heavy 25%50%. They may remain in such a lagoon for months (in some cases, actually years) before limited recovery capacity can reclaim them back into the system. As the black liquor settles, the solids drop to the bottom of the pond as they fall out of solution and suspension. Also, the heavier the solids, the faster they fall. This is especially true as the high processing temperatures fall in the lagoon environment. The black liquor solids form heavy, thick layers over time and become quite firm. The present invention comprises an apparatus for recovery of the black liquor solids from storage ponds.

SUMMARY OF THE INVENTION

The invention can be generally defined as including a side-and-rear-walled frame, basically open at the front, top and bottom; support float rollers and/or wheels supporting the frame at its front and back with the support, when they are rollers, extending at least substantially the width of the frame, and at least one blade pivotally mounted for swinging movement from an active digging position to an inactive position; cables attached to the front and rear of the frame and to prime movers on the banks of the pond; and a further cable connected to a lever arm mounted to the at least one blade for moving the blade between its active and inactive position.

In a preferred form, there are two blades, and each blade is pivotally mounted for swinging movement from an active to an inactive position, and the two blades are connected by cable means for movement in unison.

DESCRIPTION OF THE INVENTION

Figure 1:
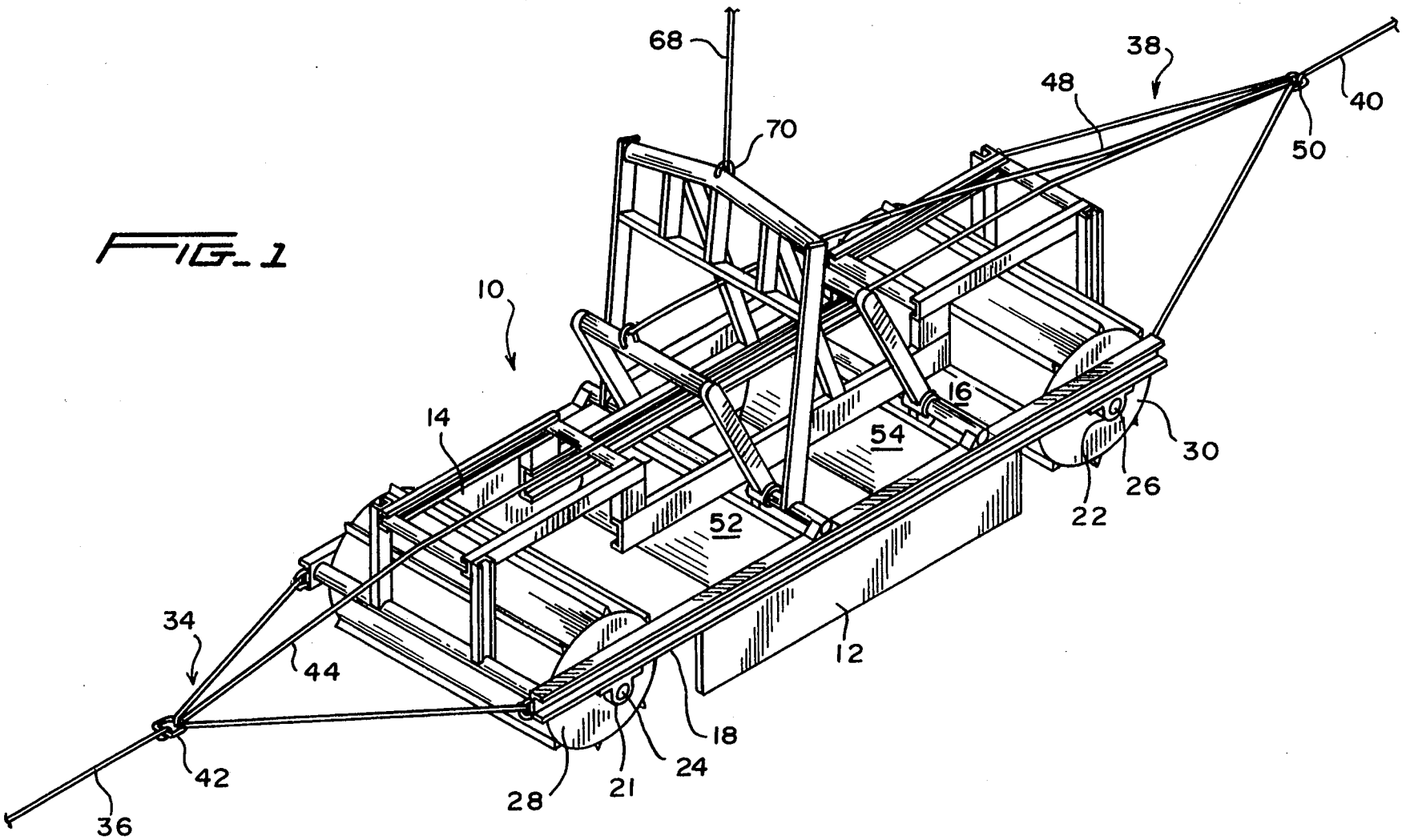
FIG. 1 is a perspective view of a dragline, dual-blade scraper having support rollers at the front and rear thereof.
Figure 2:
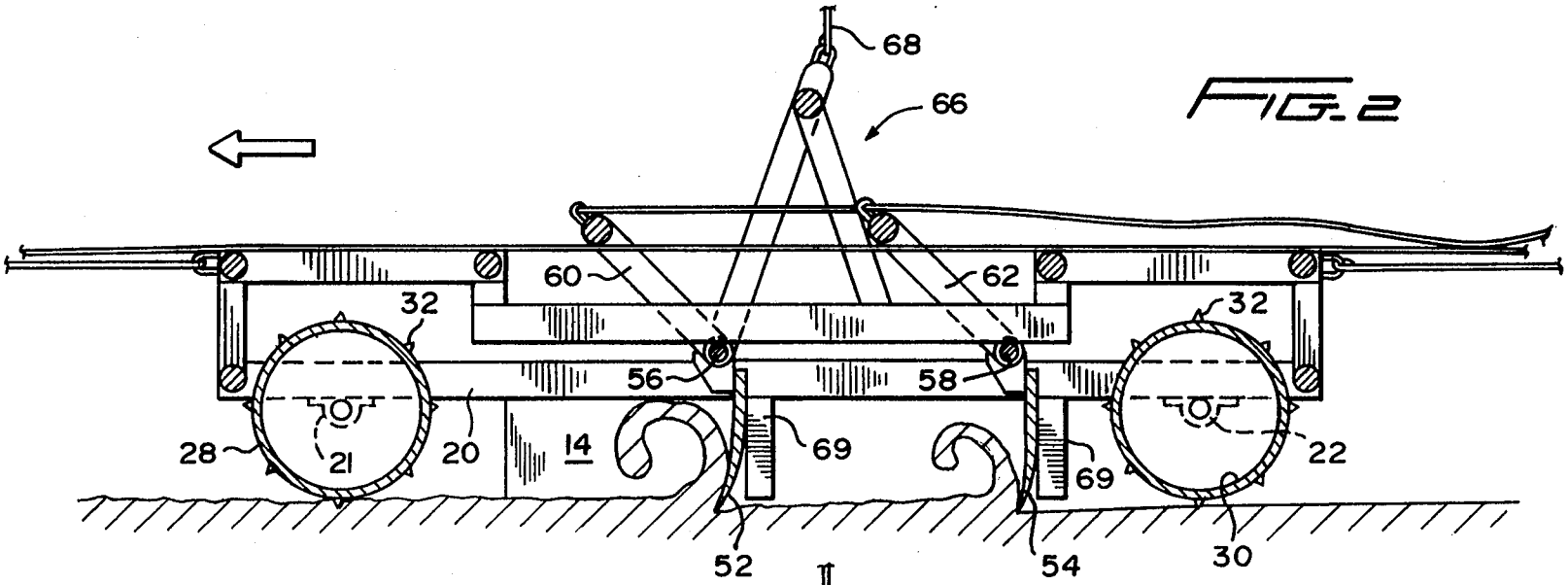
FIG. 2 is a sectional view through one form of the present invention having two blades and being towed across a pond with the blades in the active positions.
Figure 3:
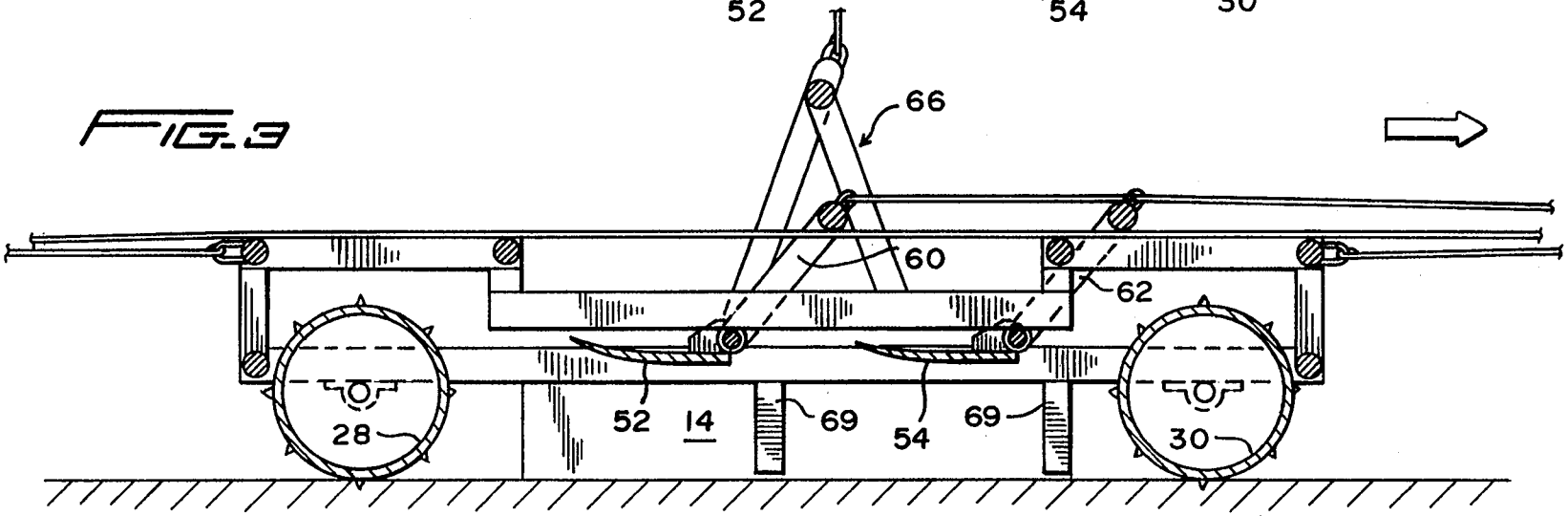
FIG. 3 is a view like FIG. 2, with the dragline scraper being pulled in the rearward direction and with the blades in an inactive position.

Referring to the drawings, 10 generally designates a unique dragline scraper. The scraper includes side walls 12 and 14 and back wall 16. The side and back walls are attached to side beams. The side frames 18 and 20 have secured thereto front and rear bearing blocks 21 and 22, into which are journaled stub shafts 24 and 26, which stub shafts are secured to front and rear floatation rollers 28 and 30. The floatation rollers have laterally extending cleats 32 secured thereto which assist in causing the rollers to rotate when the scraper is dragged in the forward or rearward directions. At the forward end, a harness, generally designated 34, is connected to the side frame members 18 and 20, and thence to a dragline 36. A similar harness 38 is secured at the rearward end of the scraper and to a rearward-pulling dragline 40.

Also secured to the connector 42 at the forward end of the vehicle is cable 44, to be described in greater detail hereinafter. A single cable at the rearward end, designated 48, is attached to connector 50, again to be described in greater detail hereinafter.

Between the side walls or frames 12 and 14 are mounted a pair of scraper blades 52, adjacent the forward end of the vehicle, and 54, adjacent the rearward end of the vehicle. The scraper blades are attached to shafts 56 for the forward blade and 58 for the rearward blade. Also secured to shaft 56 is a lever arm 60 and, at the rear, a lever arm 62 is connected to blade 54. Motion of the lever arms 60 and 62 moves the blades. When the cable 44 is urged in the forward direction, the blades are moved to the active or digging position, and the blades are moved in the opposite direction when cable 48 is urged rearwardly as the vehicle is towed in a rearward direction. A frame, generally designated 66, is secured above the blades 52 and 54, and a cable 68 is centrally attached as at 70 to the framework 66. It is through this cable 68 which, at the appropriate time, lifts the scraper vertically upward to release the mucked material collected between the side walls and the back wall 12, 14, and 16.

In order to reduce the strain or torque on cable 44 during forward and digging movement of the scraper, each of the blades has a stop member 69, which stop members are secured to the side beams 18 and 20.

Figure 6:
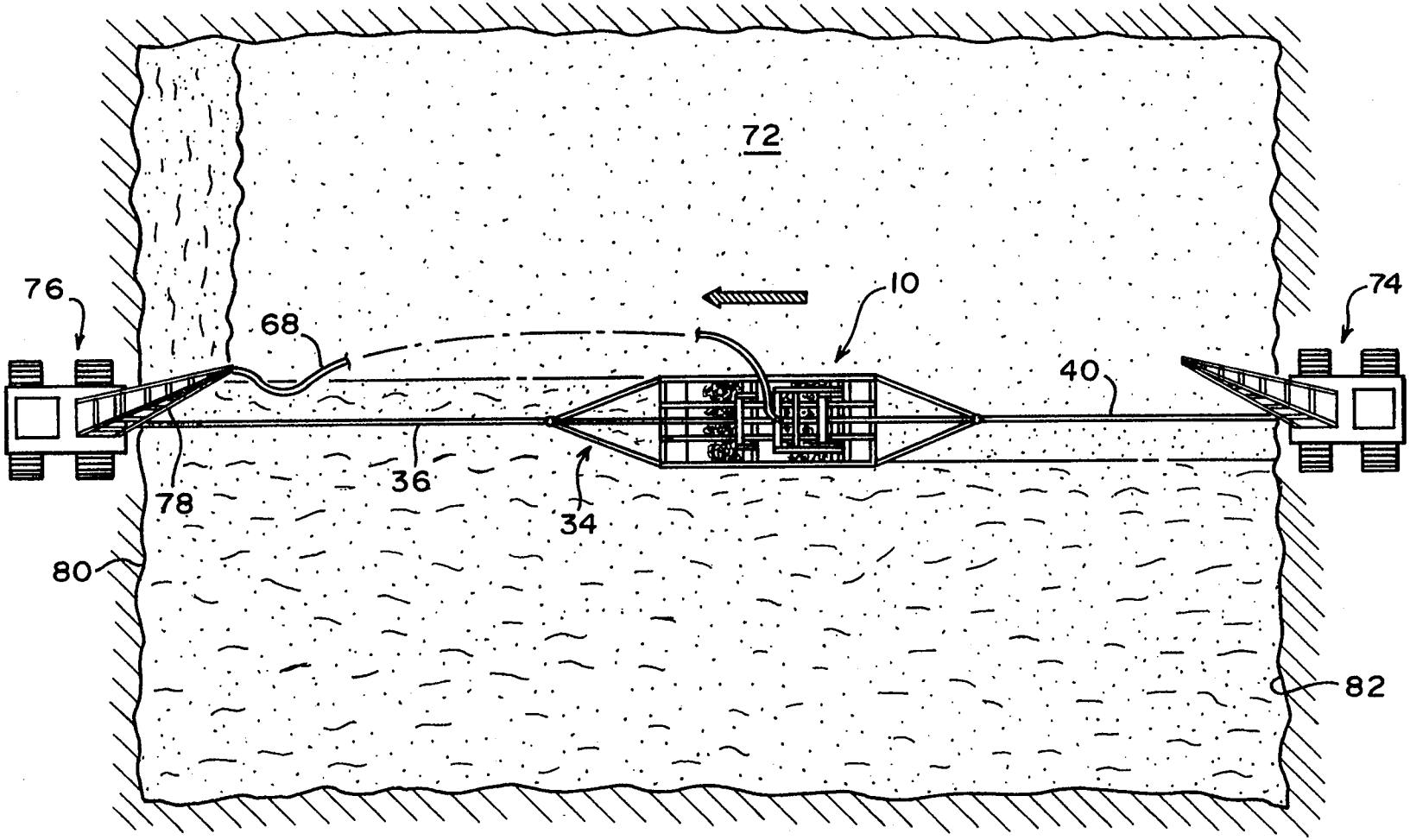
FIG. 6 is a somewhat diagrammatic view of a pond and a pair of prime movers for dragging to and from across the pond.

Referring particularly to FIG. 6, there is shown a portion of a pond 72, and on opposite banks are two prime movers in the form of cranes, designated 74 and 76. The crane 76 has a reel, not shown, for cable 36 to draw the scraper in the direction of the directional arrow, and the main reel of the crane has attached thereto, at the top of the boom 78, the cable 68, which attaches to the frame 66 for lifting the vehicle free of the collected solids when the unit reaches the bank 80. The crane 74 has a cable reel, not shown, to which is attached the cable 40 for dragging the unit 10 to the bank 82 after the mucked material has been deposited on bank 80. In the reverse direction of movement of the vehicle 10 to the bank 82, substantially no pond debris or sediment is collected, as the motion of the vehicle is opposite to the digging slope of the blades.

Figure 4:
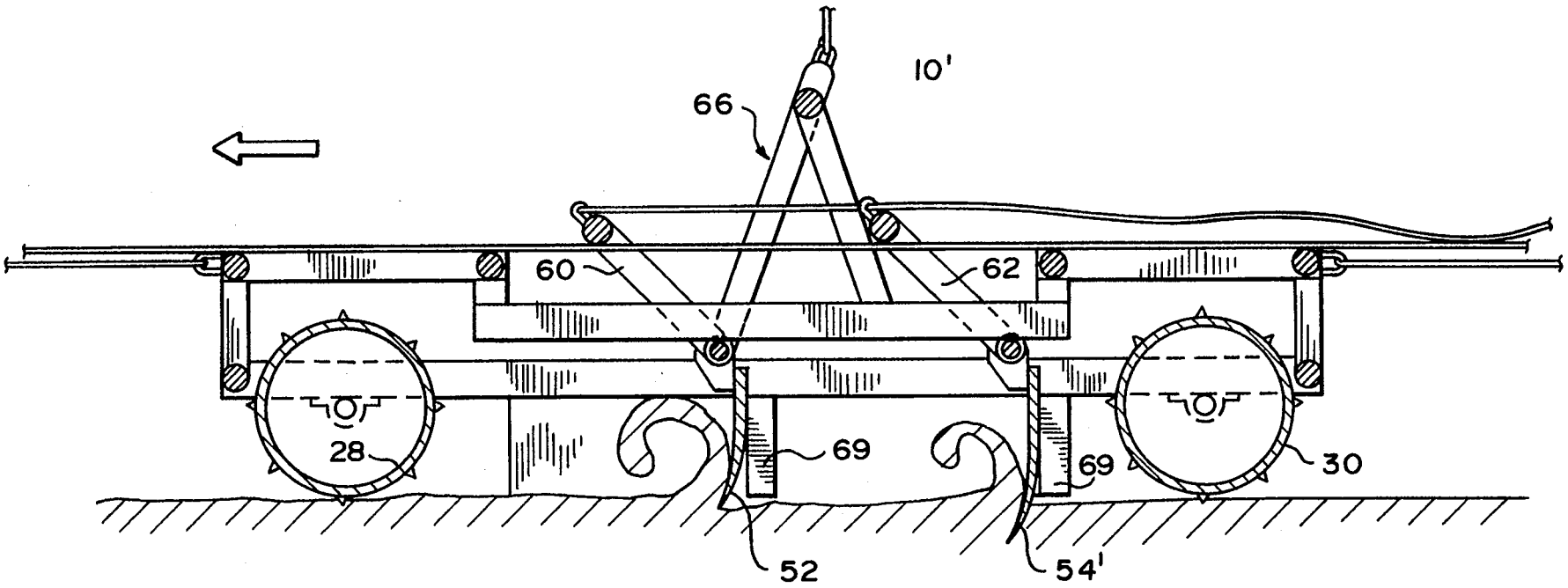
FIG. 4 is a view like FIG. 2 of a modified form of the invention wherein the rearward blade is larger than the forward blade and penetrates into the material to be mucked to a greater distance.

Referring to FIG. 4, the vehicle 10' comprises a modification from vehicle 10, in that the blade 54' is greater in length than blade 52. In this form of the invention, with a longer blade 54' in the rear, a greater load of material is collected by the pair of blades. It is also contemplated that only a single blade, either 52, 54, or 54', can be carried by the beams forming the frame of the mucking machine.

In operation of the dragline scraper, the float-type cylindrical barrels 28 and 30 keep the machine from sinking too deeply in the soft material being removed from the pond, eliminating the difficulty in mucking ponds with so-called lightweight bulldozers which have a tendency to sink too deeply into soft material, rendering the normal operation of the lightweight bulldozer impractical.

Figure 5:
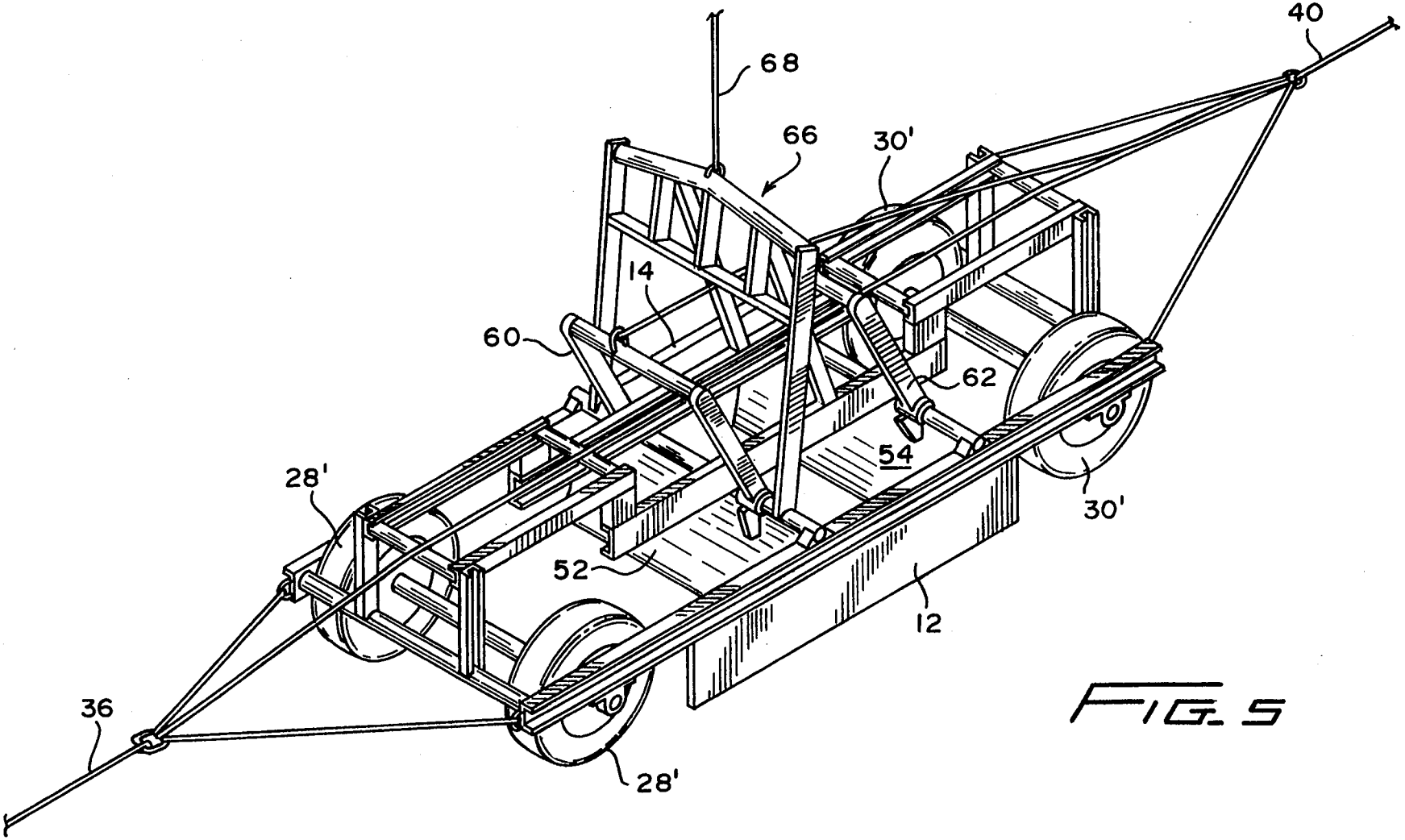
FIG. 5 is a view like FIG. 2 of a further modified form of the invention wherein the front and rear rollers are replaced by conventional wheels having rubber tires.

Referring now to FIG. 5, there is shown a modified form of the present invention, wherein the floatation rollers 28 at the front and 30 at the rear are replaced with a pair of rubber-tired wheels 28' at the forward end and a similar pair at the rear, designated 30'. The importance of this modification is to prevent the steel rollers 28 and 30 from mashing the "soft material" out of the path of the blades as the unit nears the hard bottom of the pond being excavated. Generally, as the level of the sludge is reduced to, for example, 18 inches or less, the rubber-tired wheels are used to insure that the unit will load properly and cleanly. The rear blade is also raised to the same level as the front. This prevents leveling streaks of sludge where the bottom has almost already been cleaned.

It is claimed:

1. Apparatus for cleaning waste material and sludge in clarifier and settling ponds, comprising a pair of side walls and a rear wall defining a frame open at the top, front and bottom, rotatable support means supporting the frame at the front and back of the frame, at least one blade pivotally mounted for swinging movement from an active to an inactive position between said side walls of the frame and cables attached to the front and rear of the frame, a lever arm connected to the at least one blade, and further cable means connected at one end to the lever arm and connected at the other end to the cables attached to the front and rear of the frame for moving the at least one blade to its active and inactive position, wherein the support means comprise floatation rollers supporting the frame at the front and the back of the frame, said support floatation rollers extending at least substantially the width of the frame and enabling said apparatus to float substantially on top of the waste material and sludge.

2. The apparatus, as defined in claim 1, further including a second blade, means pivotally mounting the second blade for swinging movement from an active to an inactive position and cable means connecting the said blade and said second blade for simultaneous movement.

3. The apparatus, as defined in claim 1, wherein the support rollers each has a cylindrical outer surface and a plurality of spaced drag strips secured to the cylindrical outer surface of each roller.

4. The apparatus, as defined in claim 2, wherein the said second blade is positioned rearward on the frame of said one blade, and said second blade is positioned lower than said one blade.

* * * * *